US005390795A

United States Patent [19]

Jobmann et al.

[11] Patent Number: 5,390,795

[45] Date of Patent: Feb. 21, 1995

[54] CONICAL DRUM STORAGE CONTAINER

[75] Inventors: Wolfgang Jobmann; Uwe Stier, both of Hamburg, Germany; Michael D. Naugle, Seffner, Fla.

[73] Assignee: Wolfgang Jobmann Florida, Inc., Seffner, Fla.

[21] Appl. No.: 279,502

[22] Filed: Jul. 22, 1994

[51] Int. Cl.[6] ..... B65D 7/00

[52] U.S. Cl. ..... 206/515; 220/4.04; 220/732

[58] Field of Search ..... 220/684, 732, 4.04, 220/4.05, 4.06, 4.07, 4.08, 675; 206/515

[56] References Cited

U.S. PATENT DOCUMENTS

| | | | |
|---|---|---|---|
| 2,563,352 | 8/1951 | Morse | 206/515 |
| 3,327,895 | 6/1967 | Mueller | 206/519 |
| 3,355,049 | 11/1967 | Nolan et al. | 220/4.04 |
| 3,780,899 | 12/1973 | Roper | 220/5 R |
| 3,940,008 | 2/1976 | Flanders | 220/4.07 |
| 3,952,904 | 4/1976 | Verlinden | 220/4.05 |
| 3,957,171 | 5/1976 | Besser | 220/71 |
| 4,032,031 | 6/1977 | Belokin, Jr. | 220/85 R |
| 4,141,459 | 2/1979 | Eli, Jr. | 220/85 K |
| 4,372,458 | 2/1983 | Carlson | 220/71 |
| 4,511,055 | 4/1985 | Carlson | 220/69 |
| 5,193,715 | 3/1993 | Schultz | 206/515 X |

*Primary Examiner*—Steven M. Pollard
*Attorney, Agent, or Firm*—Brian S. Steinberger

[57] ABSTRACT

A plastic conical 55 gallon storage drum apparatus is disclosed. The drum includes a generally cylindrical hollow container having a top portion, a mid portion, and a lower portion. The top portion has an outer diameter which is larger than an outer diameter of the mid portion, and the lower portion wherein the top portion and the bottom portion form a cylindrical shape, and the mid portion forms a conical shape. An elastic flexible removable bumper belt can be located about the outer diameter of the lower portion of the drum. The belt has an outer diameter approximately the same as that of the outer diameter of the top portion of the container. Filled drums can then be stored side by side together during transportation and reducing the possibility that the drums will tilt and collapse during extreme lists of approximately 30 degrees or more. The belt itself can be removed and stored in the inside bottom of the drum when the contents of the drum have been emptied. Further, the conical shapes of the drums allows for the stacking of the drums when the drums have been emptied of their contents. The elastic belts can be preformed into a ring shape from resilient material such as rubber and the like, and stretched about the lower portion of the container. Alternatively, flexible loops can be incorporated to hold the belt in place. A still another embodiment includes interspersing flexible link portions together with inflexible portions to form the belt and using a latch fastener to connect the belt into a loop shape for attachment about the lower portion of the drum.

12 Claims, 9 Drawing Sheets

CONICAL DRUM STORAGE CONTAINER

This invention relates to drum storage containers, and in particular to a novel plastic conical drum storage container for storing and shipping dry and liquid goods. This invention is related to application entitled "Apparatus For Lifting Drums", Ser. No. 08,279,488, filed on Jul. 23, 1994, by the same applicants thereof, which is incorporated by reference.

BACKGROUND AND PRIOR ART

Storage containers such as standard 55 gallon drums and the like are the usual types for storing and transporting products such as dry goods and liquids. Often for example, citrus products need to be transported by sea between locations using standard cylindrical metal drums or standard plastic conical drums.

The cylindrical metal drums have the disadvantage that the cylindrical shapes of these prior art metal drums do not allow for the easy stacking of the drums when the contents have been emptied, since the cylindrical drums cannot fit inside of one another. This lack of stacking aspect does not allow empty cylindrical drums to be returned at reasonable costs. Many empty cylindrical drums have to be destroyed and recycled at their initial shipping destination before being returned, thus increasing cost and expense.

A problem with prior art plastic conical drums occurs during transport. For example, when storing plastic conical drums together, the conical shape creates dead air spaces between adjacent drums at their bottom ends. This dead airspace allows the drums to shift and eventually collapse when a ship transporting the drums is rolling at sea. During a sea transport these drums have been known to tip over and collapse on board ships going through 30 degree or more lists. In these situations substantial damage has occurred to the drums and their contents. Furthermore, these situations are also hazardous as well as to the vessels and the crew.

Past solutions to obviate the problems of shipping conical drums have relied on using pallets with additional security strap attachments. However, shipments on pallets increases the volume (stowage factor) as well as the gross shipping weight. These increases along with the additional costs of the pallet(approximately $21 per wooden pallet used to transport four drums) and the strap attachments as well as the needed labor result in much higher and undesirable additional costs of transport.

Thus, there is a need for a drum storage container that does not have the problems associated with the prior art storage containers referred above.

SUMMARY OF THE INVENTION

The first objective of the present invention is to provide a plastic drum storage and transport container that can be stacked on top of one another when the drum contents have been emptied.

The second object of this invention is to provide a drum storage and transport container that can be transported side-by-side with other storage containers without having significant dead air space gaps between the containers.

The third object of the invention is to provide a drum storage and transport container that when shipped side-by-side does not shift nor collapses during sea transports having 30 degree or more lists.

The fourth object of this invention is to provide a drum storage and transport container with a flexible removable bottom bumper belt that can be stored in the bottom of the empty drum and thus not increase the volume of the empty drum nor be an added shipping expense during return transport.

A preferred embodiment of the novel conical storage and transport drum includes a generally cylindrical hollow container having a top portion, a mid portion, and a lower portion. The top portion has an outer diameter which is larger than an outer diameter of the mid portion, and the lower portion wherein the top portion and the bottom portion form a cylindrical shape, and the mid portion forms a conical shape. An elastic flexible removable bumper belt can be located about the outer diameter of the lower portion of the drum. The belt has an outer diameter approximately the same as that of the outer diameter of the top portion of the container. Filled drums can then be stored side by side together during transportation reducing the possibility that the drums will tilt and collapse during extreme lists of approximately 30 degrees or more. The belt itself can be removed and stored in the inside bottom of the drum when the contents of the drum have been emptied. Further, the conical shapes of the drums allows for the stacking of the drums when the drums have been emptied of their contents. The elastic belts can be preformed into a ring shape from resilient material such as rubber and the like, and stretched about the lower portion of the container. Alternatively, flexible loops can be incorporated to hold the belt in place. A still another embodiment includes interspersing flexible link portions together with inflexible portions to form the belt and using a latch fastener to connect the belt into a loop shape for attachment about the lower portion of the drum.

Further objects and advantages of this invention will be apparent from the following detailed description of a presently preferred embodiment which is illustrated schematically in the accompanying drawings.

DESCRIPTION OF THE PREFERRED EMBODIMENT

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

Figure 1A:
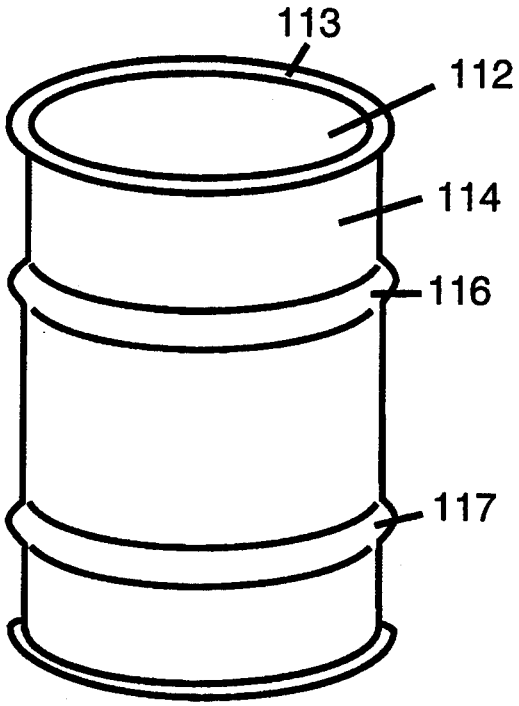
Fig. 1A (Prior Art)
FIGS. 1A and 1B shows a side exterior views of typical prior art storage drum barrels.

FIG. 1A shows a side exterior view of a prior art cylindrical 55 gallon metal storage and transport drum 100. During transport, identical drums 100 are aligned side-by-side. Each cylindrical drum typically includes a lid 112, circumferential edge ring 113 for fastening lid 112 to drum body 114 and preformed circumferential bulges 116, 118 peripherally located about the circumference of the drum body. As noted previously the cylindrical drums 100 cannot be stacked one drum into the other for return transport. Furthermore, the bulges 116, 118 and ring 113 extend out away from the sides of cylindrical drum body 114 and thus do not allow plural drums from being allowed to directly abut up against the sides of adjacent drums without creating some dead space therebetween.

Figure 1B:
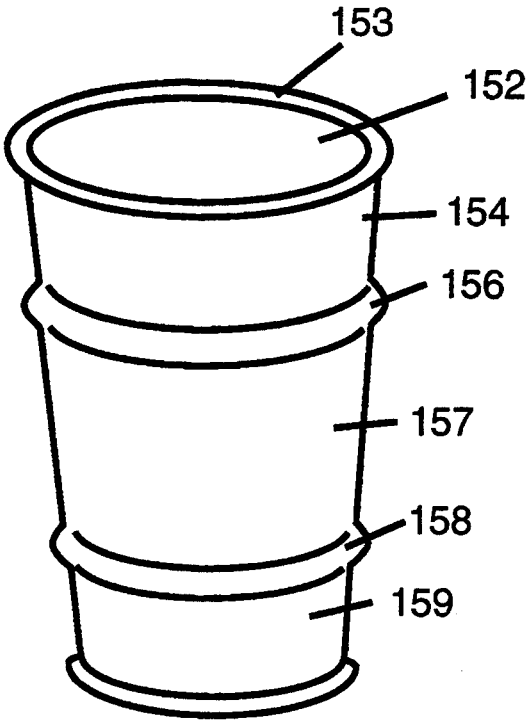
Fig. 1B (Prior Art)

FIG. 1B shows a side exterior view of a prior art conical storage drum barrels 150 typically including lid(s) 152, lid ring(s) 153 for fastening the lid 152 to body 154, along with ridge bulges 156 and 158, and where body portions 157 and 159 generally form a conical shape. However, the diameter of the lower portion 159 is significantly less than the diameter at the top portion 154 which causes dead air spaces and their related problems to be formed at the near the bottom of adjacently stored drum(s) 150.

Figure 2:
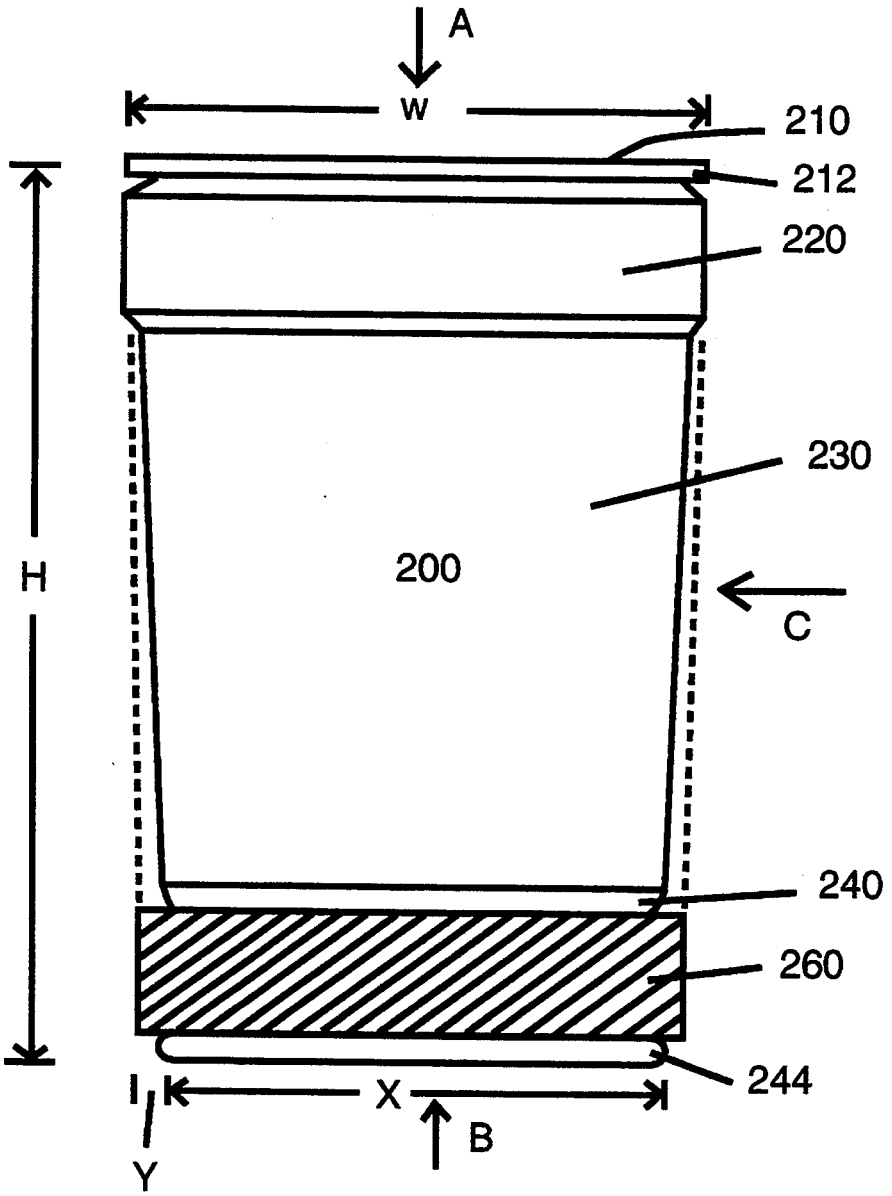
FIG. 2 illustrates an exterior view of a first preferred embodiment conical drum invention.

FIG. 2 illustrates a exterior view of a first preferred embodiment conical drum invention 200 that can be used as a 55 gallon storage container. Drum 200 can have a height, H, of approximately 37.89 inches, an upper top diameter, W, of approximately 23.86 inches and a bottom diameter, X of approximately 21.31 inches. Lid 220 can be attached to the opening on the top of drum 200 by conventional edge gripping ridges 222 and the like.

Main body portions including upper bumper area 220, middle portion 230 and bottom indented portion 240 can be a single plastic construction such as polyethylene and the like whose shape is formed from known techniques such as but not limited to injection molding and the like. The entire outer diameter of upper cylindrical bumper area 220 has a slightly larger diameter than that of lid portion 210 in order to prevent the lid rings 212 of adjacently stored drums from touching one another. Likewise, the entire outer diameter, X, of bottom indented portion 240 combined with belt 260 has the same diameter. The diameters of areas 220 and 240 can also be seen in FIG. 7.

Figure 3:
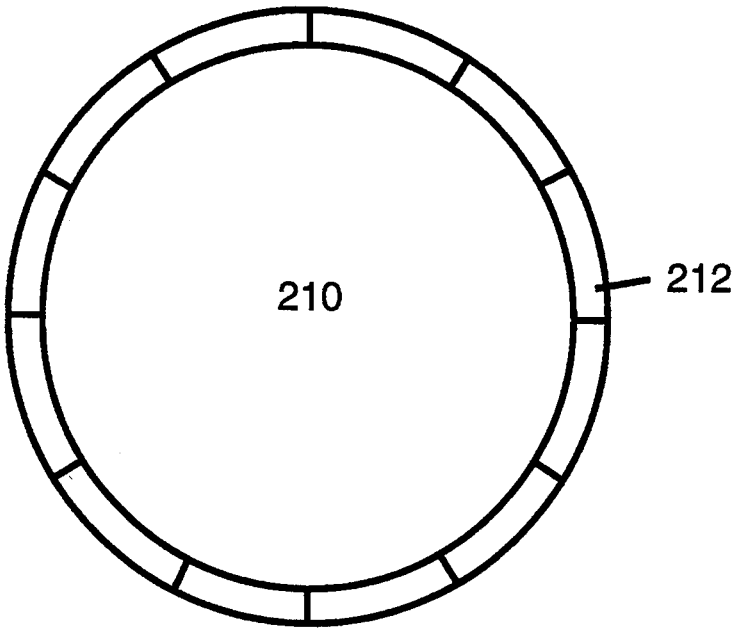
FIG. 3 shows a top view of the lid portion of the invention FIG. 2 along arrow A.
Figure 4:
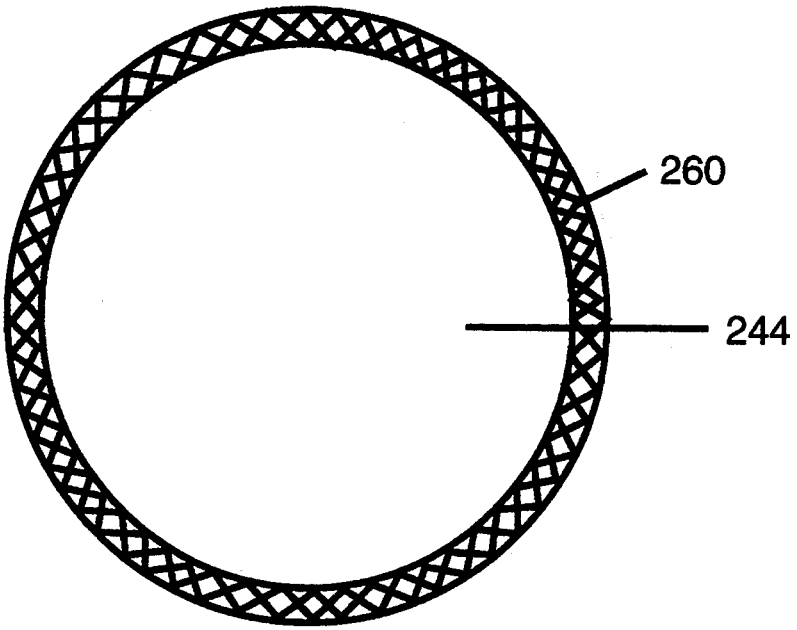
FIG. 4 shows a bottom view of the base of the invention of FIG. 2 along arrow B.

FIG. 3 shows a top view of the lid 210 with edge grip portions 212 of the invention FIG. 2 along arrow A. FIG. 4 shows a bottom view of the base 244 and belt 260 of FIG. 2 along arrow B.

Referring back to FIG. 2, the bottom indented portion 240 can include an elastic flexible band belt 260 formed from material such as but not limited to elastic rubber, elastomer materials and the like. Band belt 260 can be stretched in order to fit about indented portion 240 for a snug fit. Belt 260 can be a single ring shape also formed from techniques such as but not limited to injection molding and the like, have a thickness of approximately 1.775 inches and is flexible in the sense that the diameter of belt 260 can slightly increase or decrease with pressure and the like.

Figure 5:
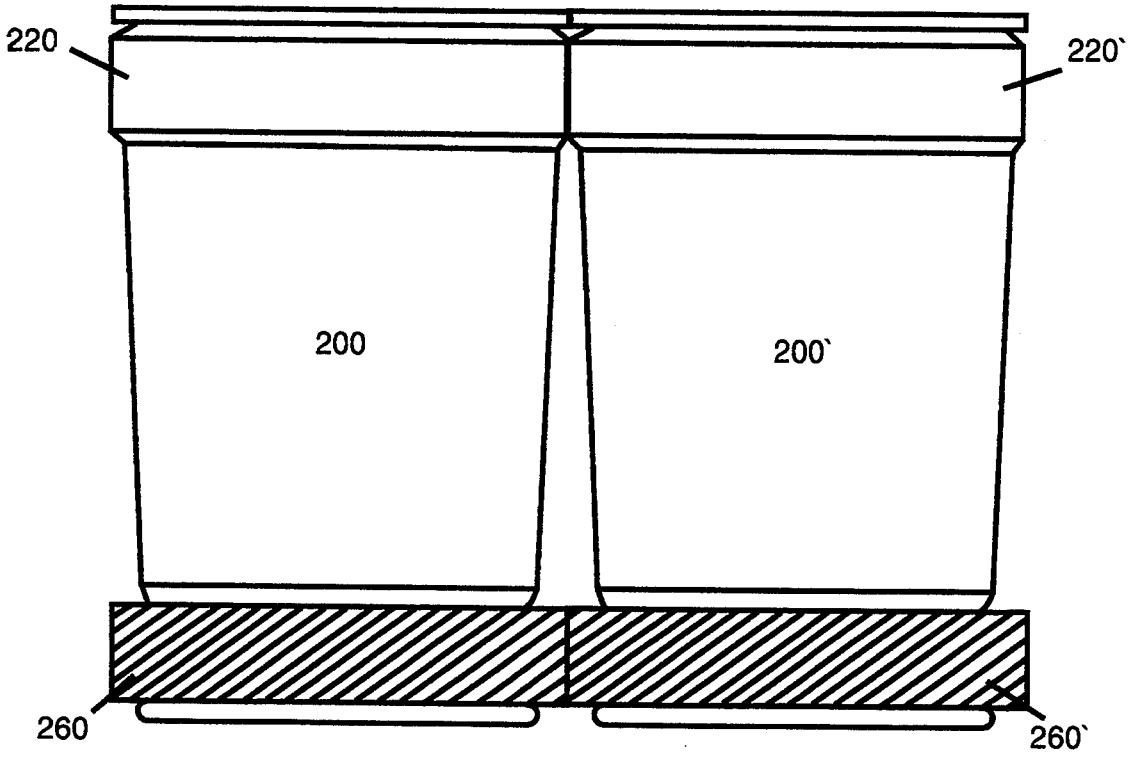
FIG. 5 shows an exterior side view of two of the embodiments of FIG. 2 side-by-side in use.

FIG. 5 shows an exterior side view of the conical drum 200 of FIG. 2 side-by-side and abutted against a similar conical drum 200' so that during transportation upper bumpers 220, 220' and lower bumpers 260, 260' abut up against their counterparts. Lower bumpers 260, 260' can also act as shock absorbers in this position.

Figure 6:
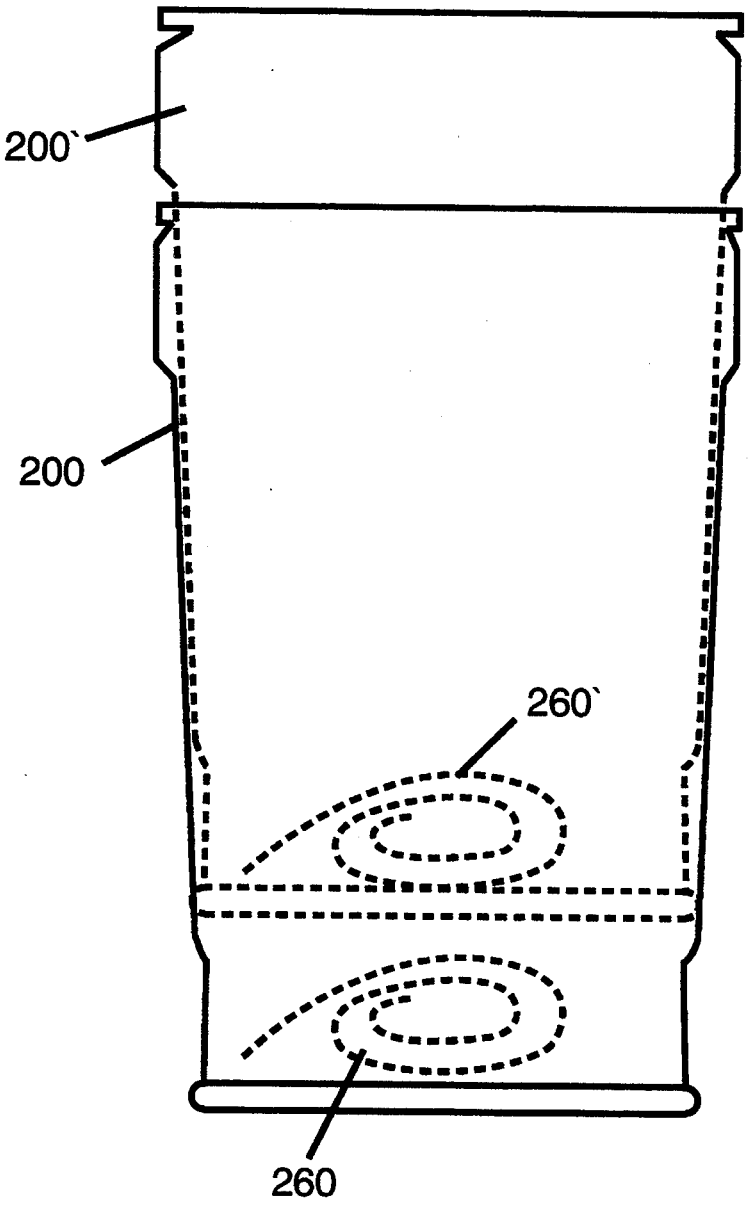
FIG. 6 shows an exterior side view of the drums of FIG. 5 when empty in a stacked position.
Figure 7:
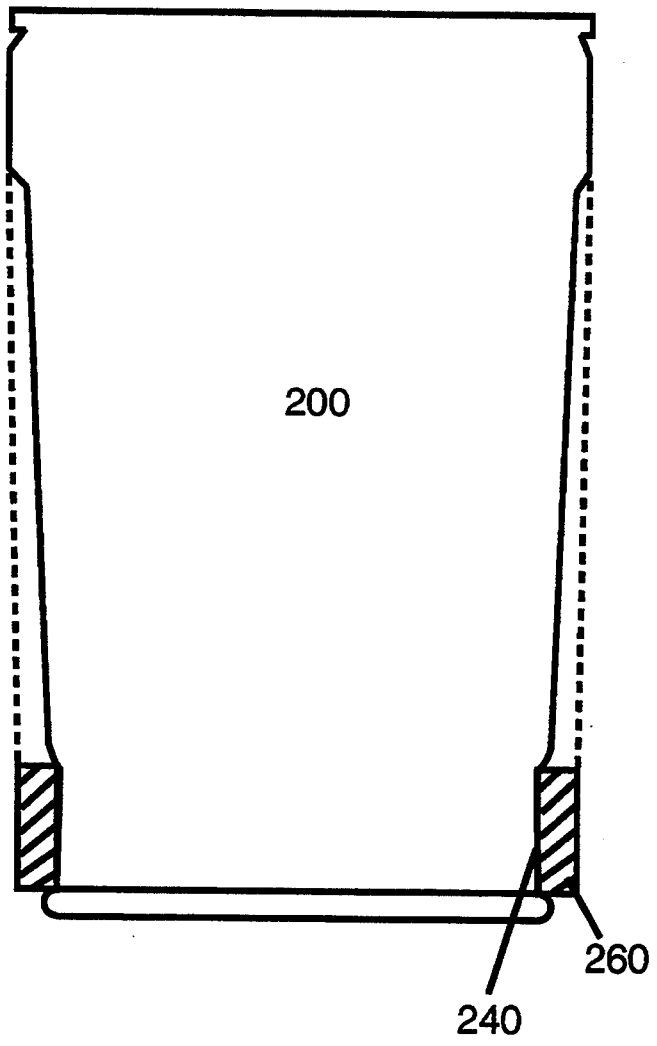
FIG. 7 illustrates a cross-sectional view of the invention of FIG. 2 along arrow C.

FIG. 6 shows an exterior side view of the drums 200 and 200' of FIG. 5 when empty of their contents in a stacked position with one inside the other. Bottom bumper belts 260 and 260' can be rolled and stored within the interior bottoms of each drum. FIG. 7 illustrates a cross-sectional view of the invention of FIG. 2 along arrow C.

Figure 8:
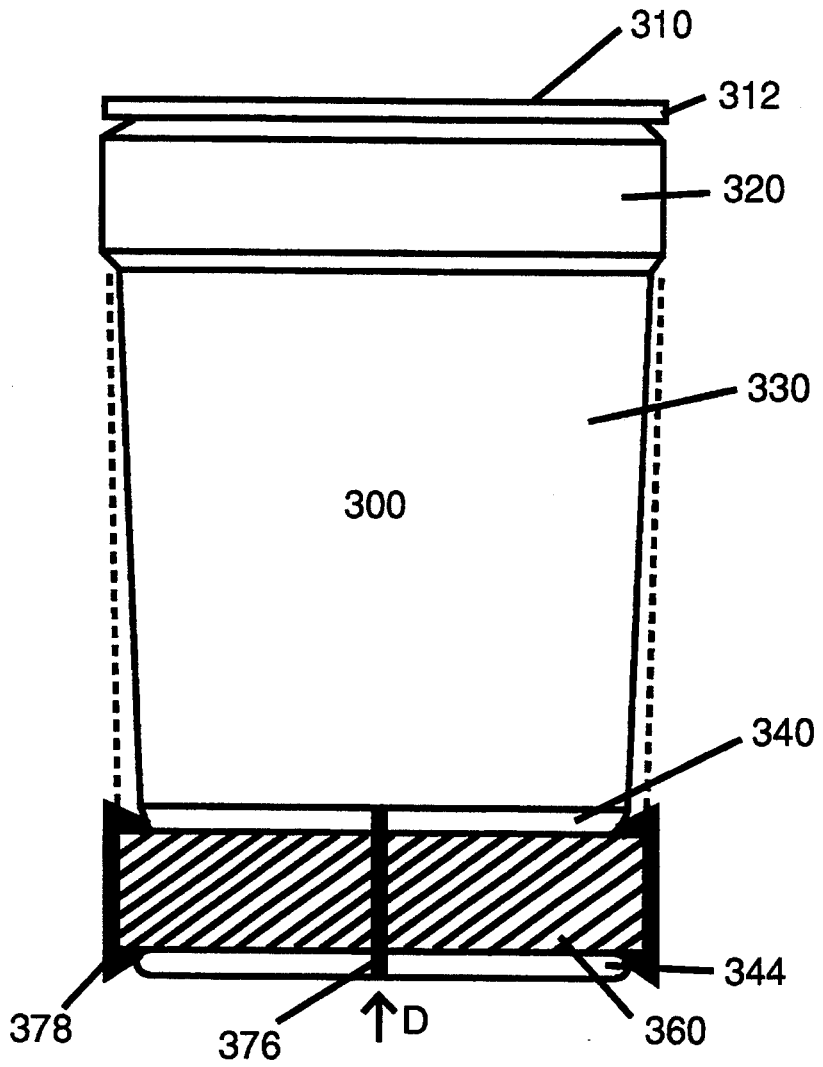
FIG. 8 illustrates an exterior side view of a second preferred embodiment conical drum invention.

FIG. 8 illustrates an exterior side view of a second preferred embodiment conical drum invention 300. In this embodiment, lid 310, edge 312, upper bumper 320, middle portion 330 and lower indented portion 340, removable belt 360 and base 344 are similar to like components 210, 212, 220, 230, 240, 260 and 244 of FIG. 2. Here, flexible belt loops 372, 374, 376 and 378 formed from plastic, fabric material and the like, are incorporated in order to better hold elastic belt 360 in place. Loops 372, 374, 376 and 378 can be attached to lower indented portion by being molded, plastic welded, adhered and the like. Although only four loops are shown any number can be incorporated as needed.

Figure 9:
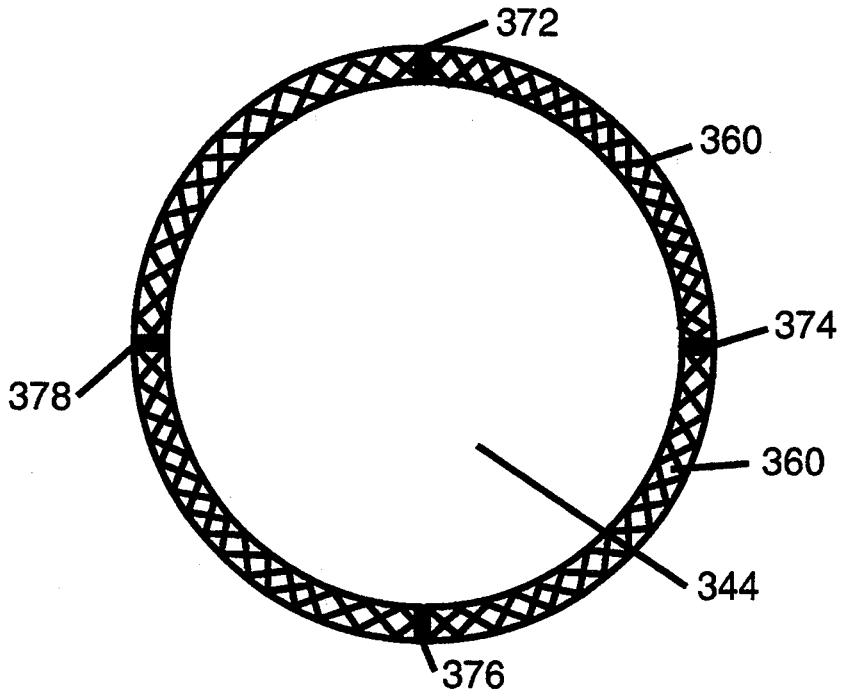
FIG. 9 show a bottom view of the base of the invention of FIG. 6 along arrow D.

FIG. 9 show a bottom view of the base 3 of the invention 300 of FIG. 6 along arrow D.

Figure 10:
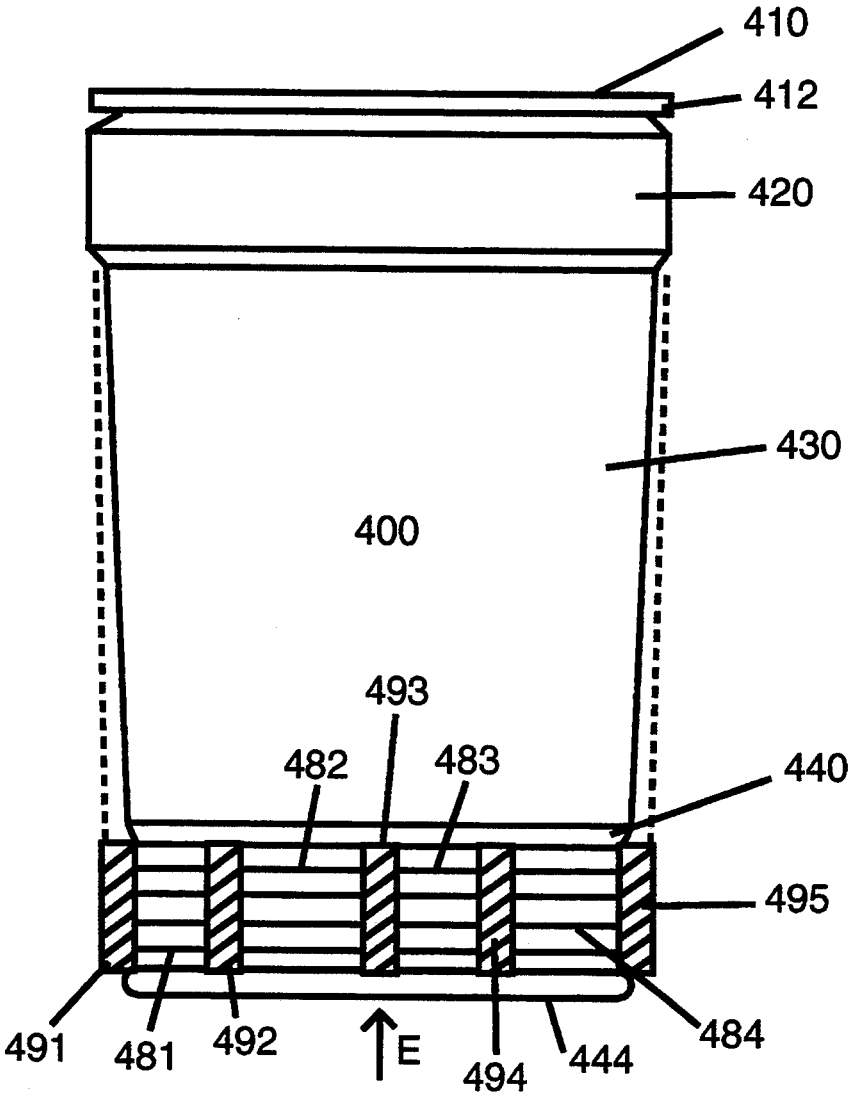
FIG. 10 illustrates an exterior side view of a third preferred embodiment conical drum invention.

FIG. 10 illustrates an exterior side view of a third preferred embodiment conical drum invention 400. In this embodiment, lid 410, edge 412, upper bumper 420, middle portion 430 and lower indented portion 440, and base 444 are similar to like components 210, 212, 220, 230, 240, 260 and 244 of FIG. 2. The bumper belt 480 comprises inflexible link portions 481 to 489 formed from material such as but not limited to plastic and the like. Bumper belt 480 further comprises interspersed connector portions 491 to 496 formed from flexible resilient elastic material such as but not limited to the same materials that make up belt 260 referred to in FIG. 2 above.

Figure 11:
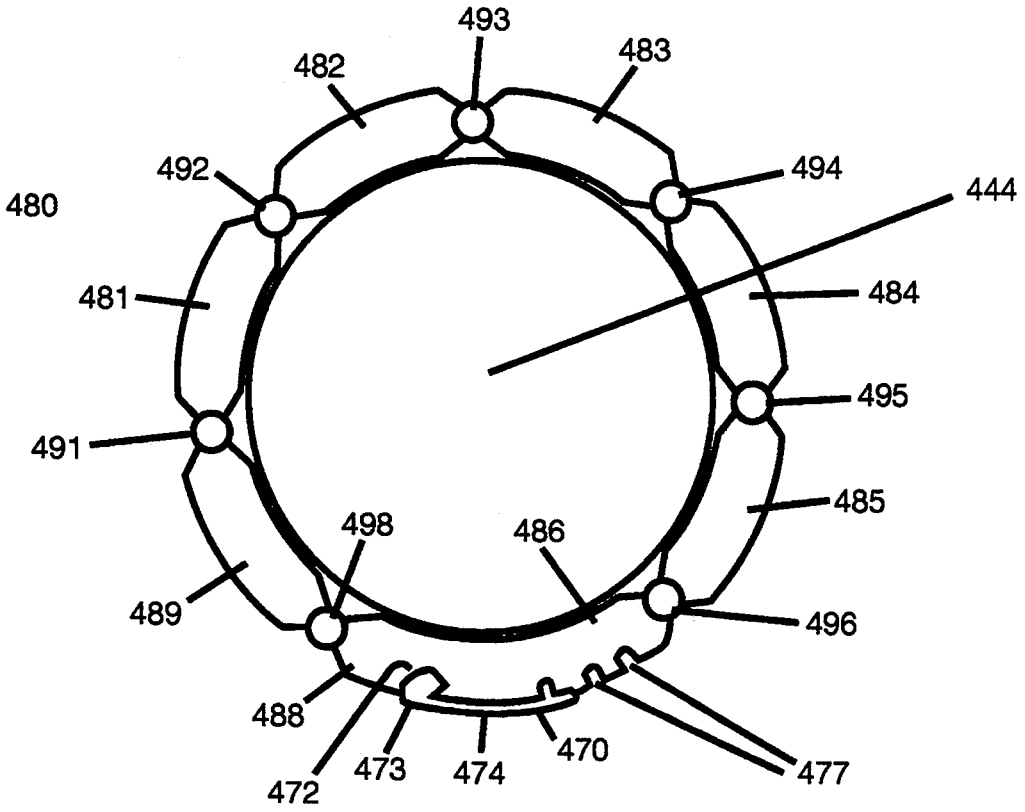
FIG. 11 shows a bottom view of the base of the invention of FIG. 8 along arrow E.

Referring back to FIG. 10, flexible connector portions 491 to 496 allow the diameter of belt 480 to stretch over and into indented portion 440 of drum 400. FIG. 11 shows a bottom view of the base 444 of the invention 400 of FIG. 8 along arrow E. While 8 link portions and 7 connector portions are shown in FIGS. 10–12, any number can be used as needed.

Figure 12:
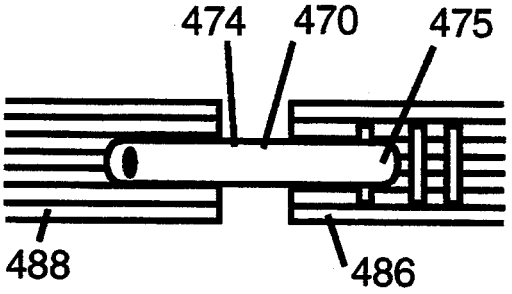
FIG. 12 shows a an exterior side view of the fastening mechanism for the invention of FIG. 8.

FIG. 12 shows a an exterior side view of a latch type fastening mechanism 470 for the invention of FIG. 8. Fastener 470 can include an embedded portion 472 that acts as a type of hinge about point 473 which is connected to a tab portion 474 that contains a protrusion 475 on its lower side for insertion into various grooved slots 477 depending upon the diameter of the belt size that is needed.

Although the embodiments listed above refer to specific belt fastener/locking systems, other locking systems can be adapted, such as but not limited to the existing the existing ring locks used to fasten the rings to the top lids of the drums.

Although, the preferred embodiment has specified that the novel conical drum can be manufactured from plastic, other types of materials can be used such as but not limited to metal, steel, aluminum, fiberglass and the like.

Although the preferred embodiment has described a conical drum having a 55 gallon capacity, other sizes can be used as needed.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

We claim:

1. A storage drum for transporting goods comprising:

a generally cylindrical hollow container having a top portion, a mid portion and a lower portion, the top portion having an outer diameter which is larger than an outer diameter of the mid portion and the lower portion, wherein the top portion and the bottom portion are of a cylindrical configuration, and the mid portion forms a conical configuration; and a bumper belt located about the outer diameter of the lower portion, the, belt having an outer diameter approximately the same as that of the outer diameter of the top portion of the container.

2. The storage drum of claim 1, wherein the belt further includes:

an elastic material.

3. The storage drum of claim 1, wherein the elastic material further includes:

rubber.

4. The storage drum of claim 1, further comprising:

a second generally hollow cylindrical container that can be aligned next to the first hollow cylindrical container during the transportation of the first and second containers when filled with contents.

5. The storage drum of claim 1, further comprising:

a second generally hollow cylindrical container whose base can be inserted within the inside of the first hollow cylindrical container after the belts on each respective container have been removed, when the contents of each respective container have been emptied.

6. The storage drum of claim 1, further comprising:

loops about the outer diameter of the lower portion for holding the removable belt therein.

7. The storage drum of claim 1, wherein the removable belt includes:

a single strip having flexible elastic link portions connected by non-flexible connectors.

8. The storage drum of claim 7, wherein the removable belt further includes:

a latch fastener for coupling and decoupling ends of the single snip together.

9. The storage drum of claim 1, wherein the container is preformed from:

plastic.

10. The storage drum of claim 9, wherein the plastic drum is preformed from:

injection molding.

11. A conical 55 gallon storage drum comprising:

a generally cylindrical hollow container having a top portion, a mid portion and a lower portion, the top portion having an outer diameter which is larger than an outer diameter of the mid portion and the lower portion, and wherein the top portion and the bottom portion are of a cylindrical configuration, and the mid portion forms a conical configuration; and a removable bumper belt located about the outer diameter of the lower portion, the belt having an outer diameter approximately the same as that of the outer diameter of the top portion of the container, wherein the belt can be removed and stored in the inside bottom of the drum.

12. The conical 55 gallon storage drum of claim 11, further comprising:

the outer diameter of the top portion is approximately 23.86 inches; and the outer diameter of the lower portion is approximately 21.31 inches.

* * * * *